US006690105B1

(12) United States Patent
Azzi et al.

(10) Patent No.: US 6,690,105 B1
(45) Date of Patent: Feb. 10, 2004

(54) DEFLECTION COIL OF A DEFLECTION YOKE

(75) Inventors: Nacerdine Azzi, Fontaine les Dijon (FR); Olivier Masson, Dijon (FR); Sebastien Volatier, Dijon (FR)

(73) Assignee: Thomson Licensing S.A., Boulogne Cedex (FR)

( * ) Notice: Subject to any disclaimer, the term of this patent is extended or adjusted under 35 U.S.C. 154(b) by 454 days.

(21) Appl. No.: 09/641,599

(22) Filed: Aug. 18, 2000

(51) Int. Cl.[7] ..... H01J 9/236
(52) U.S. Cl. ..... 313/433; 313/213; 335/216
(58) Field of Search ..... 313/433, 76; 335/213, 335/210, 340

(56) References Cited

U.S. PATENT DOCUMENTS

| | | | |
|---|---|---|---|
| 2,562,395 | A | 7/1951 | Schlesinger |
| 3,731,241 | A | 5/1973 | Coupland |
| 4,039,988 | A | 8/1977 | Van Der Heijde |

FOREIGN PATENT DOCUMENTS

| | | |
|---|---|---|
| EP | 0366196 | 5/1990 |
| FR | 2757678 | 6/1998 |
| FR | 2757681 | 6/1998 |

OTHER PUBLICATIONS

Copy of Search Report.

*Primary Examiner*—Vip Patel
*Assistant Examiner*—Kenneth Berck
(74) *Attorney, Agent, or Firm*—Joseph S. Tripoli; Harvey D. Fried; Sammy S. Henig

(57) ABSTRACT

Electromagnetic deflection unit for color cathode-ray tubes, comprising a pair of horizontal deflection coils and a pair of vertical deflection coils, the saddle-shaped vertical deflection coils having a rear bundle on the electron-gun side and a front bundle located on the screen side, lateral conductor harnesses 120 connecting the two bundles so as to produce a main window in the intermediate region lying between these said bundles, the conductor harnesses being arranged so that, at the end of the main window 18, on the gun side, at least 98% of the lateral harness conductors lie within an angular aperture $\Theta_m$ of between 60 and 80°.

This arrangement of the conductors in the rear part of the window makes it possible to minimize the aberrations due to coma parabola so as to avoid the use of additional field shapers.

4 Claims, 4 Drawing Sheets

DEFLECTION COIL OF A DEFLECTION YOKE

The invention relates to a deflection unit for colour cathode-ray tubes, which unit is also called a deflector and comprises a pair of vertical deflection coils and a pair of horizontal deflection coils in the form of a saddle, whose particular shape allows the coma errors to be minimized.

A cathode-ray tube designed to generate colour images generally comprises an electron gun emitting three coplanar electron beams, each beam being intended to excite bands of luminescent material of the corresponding colour (red, green or blue) on the tube's screen.

The electron beams scan the tube's screen under the influence of the deflection fields created by the horizontal and vertical deflection coils of the deflector which is fixed to the neck of the tube. A ring of ferromagnetic material conventionally surrounds the deflection coils so as to concentrate the deflection fields in the appropriate region.

The three beams generated by the electron gun must always converge on the tube's screen or else suffer the introduction of a so-called convergence error which, in particular, falsifies the rendition of the colours. In order to achieve convergence of the three coplanar beams, it is known to use so-called self-converging astigmatic deflection fields; in a self-converging deflection coil, the intensity of the horizontal-deflection field then has a pincushion-shaped distribution and that of the vertical deflection field has a barrel-shaped distribution.

Coma is an aberration which affects the side beams coming from an electron gun having three beams in line, independently of the astigmatism of the deflection fields and of the curvature of the screen surface of the tube; these side beams enter the deflection region at a small angle with respect to the axis of the tube and undergo a deflection in addition to that of the axial beam. The coma is generally corrected by modifying the distribution of the deflection fields at the point where the beam enters the deflector so that the coma generated compensates for that produced by the field distribution necessary to obtain the desired astigmatism for self-convergence. Thus, with regard to the horizontal deflection field, the field at the rear of the deflector has the shape of a barrel and in the front part has the shape of a pincushion.

Field configurations like those described above may cause the appearance of aberrations called coma parabolas which are manifested in a rectangular test pattern displayed on the tube's screen by an increasing shift of the green image with respect to the red/blue image as one approaches the corners of the test pattern. If the shift is towards the outside of the test pattern, the coma error is conventionally positive, while if it is towards the inside of the said test pattern the coma error is negative.

Simultaneous control, by means of a particular configuration of the conductors making up the deflection coils, of the coma, coma parabola, convergence and geometry errors has not hitherto been possible without adding additional components, such as metal pieces, arranged so as to cause local modification of the deflection fields for the purpose of correcting the coma errors, or permanent magnets for correcting the geometry defects. French Patent No. 2,757,678 describes a horizontal deflection coil configuration allowing correction of either vertical or horizontal coma parabola problems; however, since the horizontal and vertical coma parabolas are intimately linked variation-wise, the configuration described by the said application does not make it possible to correct both horizontal and vertical coma parabolas, particularly when the latter are of opposite sign, this being due to their opposing behaviour, correction of one causing degradation of the other.

Moreover, these problems of the geometry of the image, of coma and of convergence are connected with the planarity of the screen and with the size of the latter. Conventional cathode-ray tubes manufactured a few years ago and using a screen of spherical shape generally have a small radius of curvature. Since the current trend is moving towards screens of large radius of curvature, or else completely flat screens, with diagonals greater than 70 cm in length, it is becoming increasingly difficult to control the abovementioned problems solely by means of suitable fields generated by the deflection coils.

It is common practice to divide the deflection system into three successive action regions along the main axis of the tube: the rear region closest to the electron gun influences more particularly the coma, the intermediate region acts more particularly on the astigmatism of the deflection field and therefore on the convergence of the red and blue electron beams and, finally, the front region, lying closest to the tube's screen, acts on the geometry of the image which will be formed on the tube's screen.

The object of the present invention is to make it possible, by a particular arrangement of the winding wires of the vertical deflection coils, to generate deflection fields no longer requiring the use of additional correctors to minimize the coma parabola errors down to an acceptable level, without irreversibly modifying the other design parameters of the deflector, such as the convergence of the electron beams and the geometry of the image formed on the tube's screen.

To do this, the electromagnetic deflection unit for cathode-ray tubes according to the invention comprises a pair of horizontal deflection coils and a pair of vertical deflection coils, the vertical deflection coils being in the shape of a saddle and comprising a front bundle lying on the screen side of the tube and a rear bundle lying on the electron-gun side, the said bundles being connected to each other by lateral conductor harnesses, the front and rear bundles and the lateral harnesses defining a window free of conductors, which deflection unit is characterized in that, in the region close to the rear bundle, at least 98% of the lateral harness conductors lie within an angular aperture $\Theta_m$ of less than 80°.

Other features and advantages of the invention will appear from the description below and from the drawings, among which:

Figure 4:
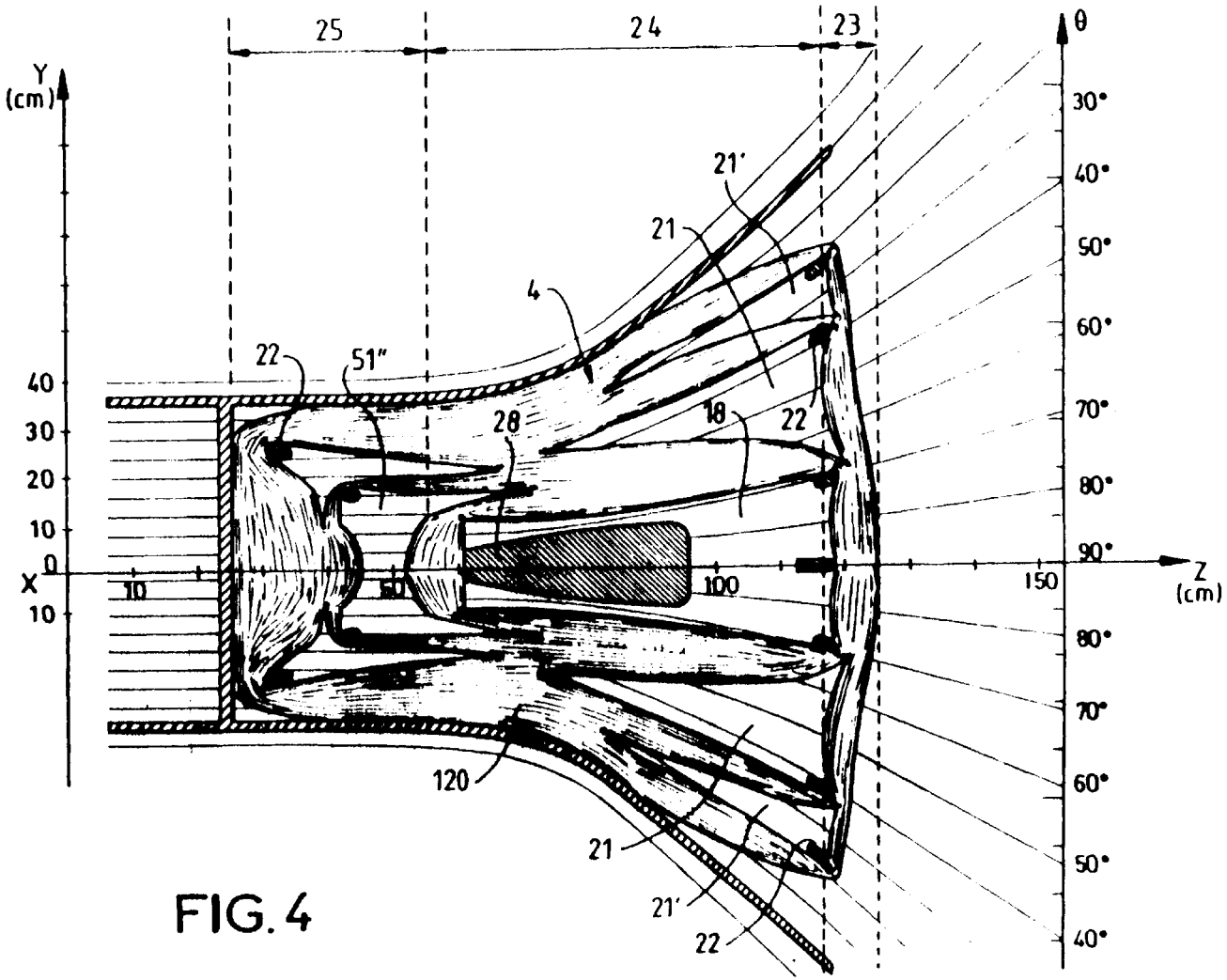
Figure 5:
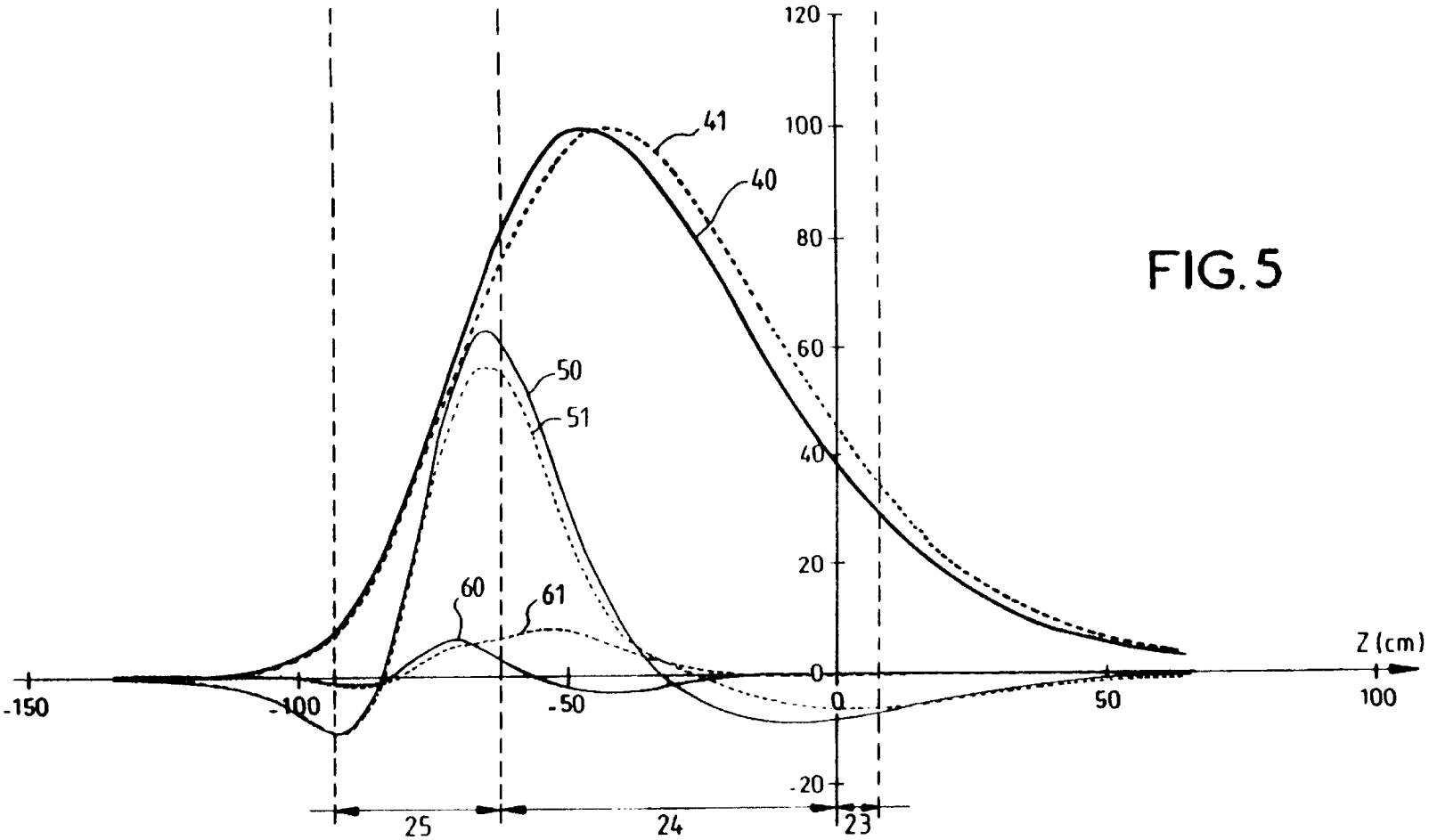

FIG. 4 illustrates an embodiment of a vertical deflection coil according to the invention in y, z, Θ representation; and FIG. 5 shows the variation along the main axis Z of the tube of the coefficients of the distribution function for the vertical deflection field generated by a coil according to the invention and the influence of the particular arrangement of the lateral harness conductors on the said coefficients.

Figure 1:
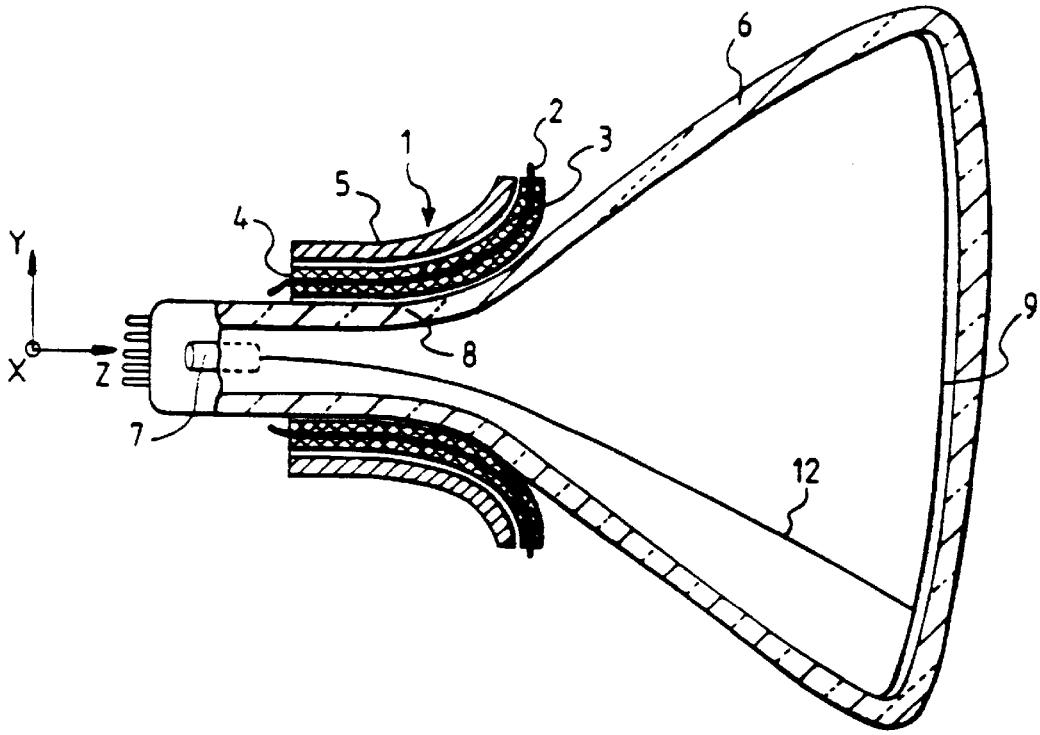
FIG. 1 shows a cathode-ray tube equipped with a deflector according to the invention.

As illustrated in FIG. 1, a self-converging colour display device comprises a cathode-ray tube fitted with an evacuated glass envelope 6 and an array of phosphors representing various colours, these phosphors being arranged at one of the ends of the envelope, forming a display screen 9, and a set of electron guns 7 arranged at a second end of the envelope. The set of electron guns is arranged so as to produce three electron beams 12 aligned horizontally so as to excite, respectively, one of the various colour phosphors. The electron beams scan the entire surface of the screen by means of a deflection system 1, or deflector, which is placed on the neck 8 of the tube and comprises a pair of horizontal deflection coils 3, a pair of vertical deflection coils 4, these being isolated from each other by a separator 2, and a core 5 made of ferromagnetic material intended to concentrate the field at the point where it is designed to act.

Figure 2:
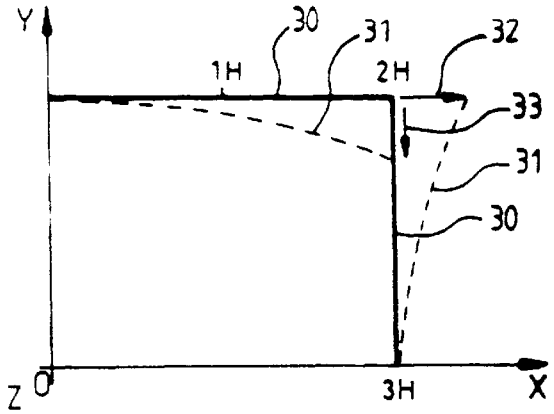
FIG. 2 shows schematically a quarter of a colour cathode-ray tube screen on which the aberrations called coma parabola may be seen.

FIG. 2 illustrate a coma parabola aberration that the present invention aims to minimize. A test pattern is displayed on a quarter of the screen and illustrates the shift of the images created by the red/blue beams—the solid lines 30—with respect to the image created by the green beam—the dotted lines 31. As defined above, FIG. 2 illustrates the case in which, at the 2 o'clock point representing the corner of the screen, the horizontal coma error 32 and the vertical coma error 33 are of opposite sign.

Figure 3:
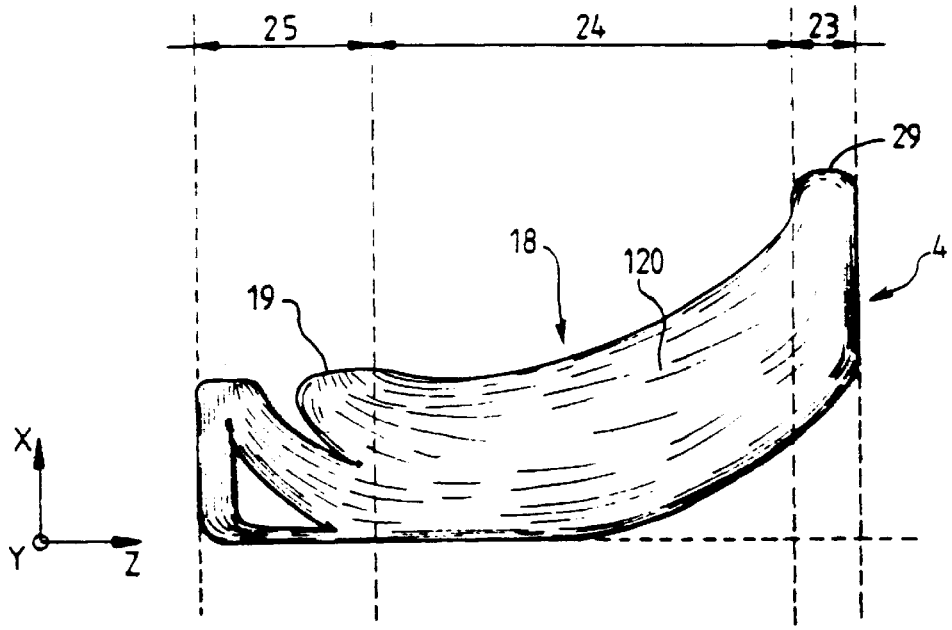
FIG. 3 is a side view of a coil according to the invention.

FIG. 3 illustrates, by means of a side view, one of the pairs of saddle-shaped coils 4 implementing one aspect of the invention. Each winding turn is formed by a loop of conductor wire generally having the shape of a saddle.

Within the scope of the invention, each vertical deflection coil of the deflector 1 has the shape of a saddle and has a portion 19 called a rear end bundle, close to the electron gun 7 and preferably extending in a direction perpendicular to the Z axis. A second portion 29, called the front end bundle, of the coil 10 is close to the display screen 9 and is incurvate on moving away from the Z axis in a direction generally transverse to the latter. The front end bundle 29 of the saddle-shaped coil 4 is connected to the rear end bundle 19 by groups of lateral conductors 120. The bundles 19 and 29 as well as the lateral groups of conductors 120 define a main window 18. Taking as reference the direction of flow of the electrons making up the three beams coming from the gun 7, the region over which the window 18 extends is called the intermediate region 24, the region over which the conductors making up the front bundle fan out is called the exit region 23 and that region of the coil which lies to the rear of the window 18, making up the rear bundle, is called the entry region 25.

It is known that the coma errors are corrected in the entry region 25 of the deflection coils. The convergence errors are corrected in the intermediate region 24, between the exit and entry regions. The geometrical errors at the extreme edges of the display screen are corrected in the exit region 23.

A saddle-shaped coil as described above may be wound with a fine copper wire, the wire being covered with an electrical insulation and with a thermosetting adhesive. The winding is carried out in a winder which winds the saddle-shaped coil essentially in its final form and which introduces spaces 21, 21', 21", etc., during the winding process. The shapes and the positions of these spaces are defined by retractable pins 22 or by inserts 28. After winding, each saddle-shaped coil is held in place in a jig and pressure is applied to it so as to obtain the required mechanical dimensions. A current flows through the wire so as to soften the thermosetting adhesive, which is then cooled so as to bond the wires together and to form a self-supporting saddle-shaped coil.

Hitherto, the shapes of the coils did not make it possible to control the horizontal and vertical coma parabola errors at the same time, mainly when these errors are of opposite sign. Using the teaching of French Patent FR 2,757,678, it is noticed that in the case of coma parabola errors of opposite sign, when the horizontal coma is improved the vertical coma deteriorates, and vice versa.

FIG. 4 illustrates an embodiment of the invention in which the vertical deflection coil is shown in Y, Z, Θ, Θ being the value of the angle defining the radial position in the transverse plane parallel to XY of a conductor of the coil lying in Y, Z with respect to the plane of separation YZ of the two vertical deflection coils.

In a known manner, the coma errors are minimized by introducing windows 21" into the region 25 where the rear bundle 19 is located. Based on this teaching, it is proposed to control or minimize, down to an acceptable value, the coma parabola aberrations in the following manner:

- the horizontal and vertical coma parabola error is minimized by known means, for example by introducing suitable windows into the rear bundle 29;
- the rear of the main window 18 of the vertical deflection coil is then widened with respect to the prior art so that, near the transition region between the parts 24 and 25 of the coil, at least 98% of the lateral harness conductors lie within a radial angular aperture $\Theta_m$ of less than 80°, $\Theta_M$ being measured with respect to the plane of separation YZ of the two vertical deflection coils.

The modification of the configuration of the main window and in particular of its rear part makes it possible to modify the vertical coma parabola without modifying the horizontal coma parabola, something which was not possible using the known techniques.

In the case of large-sized tubes, having a screen diagonal of greater than 70 cm, experience shows that $\Theta_M$ is preferably chosen within a range of between 60° and 80°.

For example, in the case of a tube having a diagonal of 97 cm, of 16/9 screen format, the vertical deflection coil of which is in accordance with FIG. 4, the lateral harness conductors lie, to the rear of the main window 18, within a radial angular aperture of 65°.

The tables below compare, on a quarter of a screen, the results obtained with a deflector equipped with vertical deflection coils according to the prior art, that is to say coils whose conductors to the rear of the main window are arranged in an angular aperture of greater than 80°, in this case 82°, and a deflector equipped with vertical deflection coils according to the invention, for the abovementioned tube of 97 cm diagonal. Prior to modifying the rear part of the main window, the horizontal coma parabola was brought to an acceptable low level.

Vertical coils according to the prior art (the coma is expressed in mm):

| 12 o'clock | 2 o'clock | 12 o'clock | | 2 o'clock |
|---|---|---|---|---|
| 0.10 | 0.27 | 0.00 | −0.18 | −1.18 |
| −0.01 | −0.12 | 0.00 | −0.09 | −0.36 |
| 0.00 | 0.00 | 0.00 | 0.00 | 0.00 |
| | 3 o'clock Horizontal coma | | | 3 o'clock Vertical coma |

Vertical coils according to the invention:

| 12 o'clock | | 2 o'clock | 12 o'clock | | 2 o'clock |
|---|---|---|---|---|---|
| 0.21 | 0.26 | 0.28 | 0.00 | −0.05 | −0.46 |
| 0.08 | 0.06 | 0.00 | 0.00 | −0.03 | −0.14 |
| 0.00 | 0.00 | 0.00 | 0.00 | 0.00 | 0.00 |
| | | 3 o'clock Horizontal Coma | | | 3 o'clock Vertical coma |

It may be seen that the vertical coma parabola aberration has been greatly reduced without excessively modifying the horizontal coma parabola.

The effect on the vertical magnetic field created by this modification is illustrated in FIG. 5.

This figure shows, along the main axis Z, the fundamental and the $2^{nd}$ and $4^{th}$ harmonics, labelled 41, 51 and 61 respectively, of the deflection field of the coil according to the prior art and the fundamental and the $2^{nd}$ and $4^{th}$ harmonics, labelled 40, 50 and. 60 respectively, of the vertical deflection coil of the same embodiment of the invention as above.

Experimenting has shown that the vertical coma parabola aberration was minimized by making sure that the integral along the Z axis of the $4^{th}$ harmonic of the vertical deflection field is as small as possible. To do this, near the rear bundle in the region 24 of the main window, arrangements are made to modify the $4^{th}$ harmonic so as to change its sign so that it has, over most of the region 24 of the main window, a sign opposite to that which it has mainly in the entry region 25.

Taking into account other design parameters entails certain modifications to the front part of the main window 18 lying near the transition region between the parts 23 and 24 of the coil. However, at least in the case of large-sized tubes, experimenting shows that the radial aperture of the said window 18 in its front part remains substantially less and at least equal to its radial aperture in its rear part so as not to comprise the effect obtained on the coma parabola errors.

Thus, in the embodiment relating to the tube of 97 cm diagonal, the best results were obtained with a radial aperture of the window 18 such that the lateral harness conductors, to the front of the coil, near the exit region 23, lie within an angular aperture of 72°.

What is claimed is:

1. Electromagnetic deflection unit for cathode-ray tubes; comprising:

a pair of horizontal deflection coils and a pair of vertical deflection coils, the vertical deflection coils being in the shape of a saddle, each verticle deflection coil including a front bundle lying on the screen side of the tube and a rear bundle lying on the electron-gun side, the said bundles being connected to each other by lateral conductor harnesses, the front and rear bundles and the lateral harnesses defining a window free of conductors, wherein, in the region close to the rear bundle, at least 98% of the lateral harness conductors lie within an angular aperture $\Theta_m$ of less than 80°.

2. Electromagnetic deflection unit according to claim 1, wherein at least 98% of the lateral harness conductors lie within an angular aperture $\Theta_m$ of between 60° and 80°.

3. Deflection unit according to claim 1 wherein, in the region close to the front bundle, the lateral harness conductors lie within an angular aperture equal to or greater than $\Theta_m$.

4. Electromagnetic deflection unit for cathode-ray tubes, comprising:

a pair of horizontal deflection coils; and a pair of vertical deflection coils, the vertical deflection coils being in the shape of a saddle, each coil comprising a front bundle lying on the screen side of the tube and a rear bundle lying on the electron-gun side, the bundles being connected to each other by lateral conductor harnesses, the front and rear bundles and the lateral harnesses defining a window free of conductors, wherein the lateral conductor harnesses are arranged in a region close to the rear bundle to cause the $4^{th}$ harmonic of the vertical deflection field to change sign to the rear of the said window, near the rear bundle.

* * * * *